US007612721B2

(12) United States Patent
Jean

(10) Patent No.: US 7,612,721 B2
(45) Date of Patent: Nov. 3, 2009

(54) ELECTRONIC DEVICE HAVING ANTENNA FUNCTION

(75) Inventor: Jin-Tsang Jean, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/967,110

(22) Filed: Dec. 29, 2007

(65) Prior Publication Data

US 2008/0174498 A1 Jul. 24, 2008

(30) Foreign Application Priority Data

Jan. 19, 2007 (CN) ..... 2007 1 0200084

(51) Int. Cl.
*H01Q 1/38* (2006.01)

(52) U.S. Cl. ..... 343/700 MS; 343/702

(58) Field of Classification Search ..... 343/702, 343/700 MS
See application file for complete search history.

(56) References Cited

U.S. PATENT DOCUMENTS

| | | | | |
|---|---|---|---|---|
| 6,255,994 | B1 * | 7/2001 | Saito | 343/700 MS |
| 6,486,836 | B1 | 11/2002 | Hill | |
| 6,774,849 | B2 * | 8/2004 | Umehara et al. | 343/700 MS |
| 2003/0030587 | A1 * | 2/2003 | Yuasa et al. | 343/700 MS |
| 2004/0085245 | A1 * | 5/2004 | Miyata et al. | 343/700 MS |
| 2007/0188384 | A1 * | 8/2007 | Liu | 343/700 MS |

* cited by examiner

*Primary Examiner*—James H. Cho
*Assistant Examiner*—Jany Tran
(74) *Attorney, Agent, or Firm*—Frank R. Niranjan

(57) ABSTRACT

An electronic device (10) includes a substrate (11), a metal film (12), a radio frequency module (14), and a signal transmission portion (13). The substrate includes two opposite surfaces. The metal film is disposed on one surface of the substrate and defines a clearance (16) therein. The radio frequency module is disposed on the clearance. The signal transmission portion is electronically connected to the radio frequency module and the metal film, for transmitting electromagnetic signals between the radio frequency module and the metal film.

9 Claims, 5 Drawing Sheets

ELECTRONIC DEVICE HAVING ANTENNA FUNCTION

BACKGROUND

1. Field of the Invention

The present invention relates to electronic devices, and particularly to an electronic device used in a wireless communication apparatus.

2. Description of Related Art

With rapid developments in wireless communication technologies, many wireless communication modules, such as television (TV) modules, Bluetooth modules, and application modules of Digital Video Broadcasting-Handheld (DVB-H), are embedded in advanced electronic devices. The wireless communication modules receive signals from satellites or base stations conventionally by use of antennas, such as the external antennas 90 of a mobile phone 20 shown in FIG. 1.

However, the external antennas 90 generally have narrower bandwidth, and performances thereof are not good when they work at low frequencies. In addition, the external antennas 90 may increase the size and total manufacturing cost of the wireless communication modules.

Therefore, a heretofore unaddressed need exists in the industry to overcome the aforementioned deficiencies and inadequacies.

SUMMARY OF THE INVENTION

One aspect of the present invention provides an electronic device. The electronic device includes a substrate, a metal film, a radio frequency module, and a signal transmission portion. The substrate includes two opposite surfaces. The metal film is disposed on one surface of the substrate and defines a clearance therein. The radio frequency module is disposed on the clearance. The signal transmission portion is electronically connected to the radio frequency module and the metal film, for transmitting electromagnetic signals between the radio frequency module and the metal film.

Another aspect of the present invention provides a plane antenna. The plane antenna includes a substrate, a metal film, and a signal transmission portion. The substrate includes two opposite surfaces. The metal film is disposed on one surface of the substrate for radiating electromagnetic signals. The signal transmission portion is electronically connected to the metal film for transmitting electromagnetic signals to the metal film.

Other objectives, advantages and novel features of the present invention will be drawn from the following detailed description of preferred embodiments of the present invention with the attached drawings, in which:

DETAILED DESCRIPTION OF THE INVENTION

Figure 1:
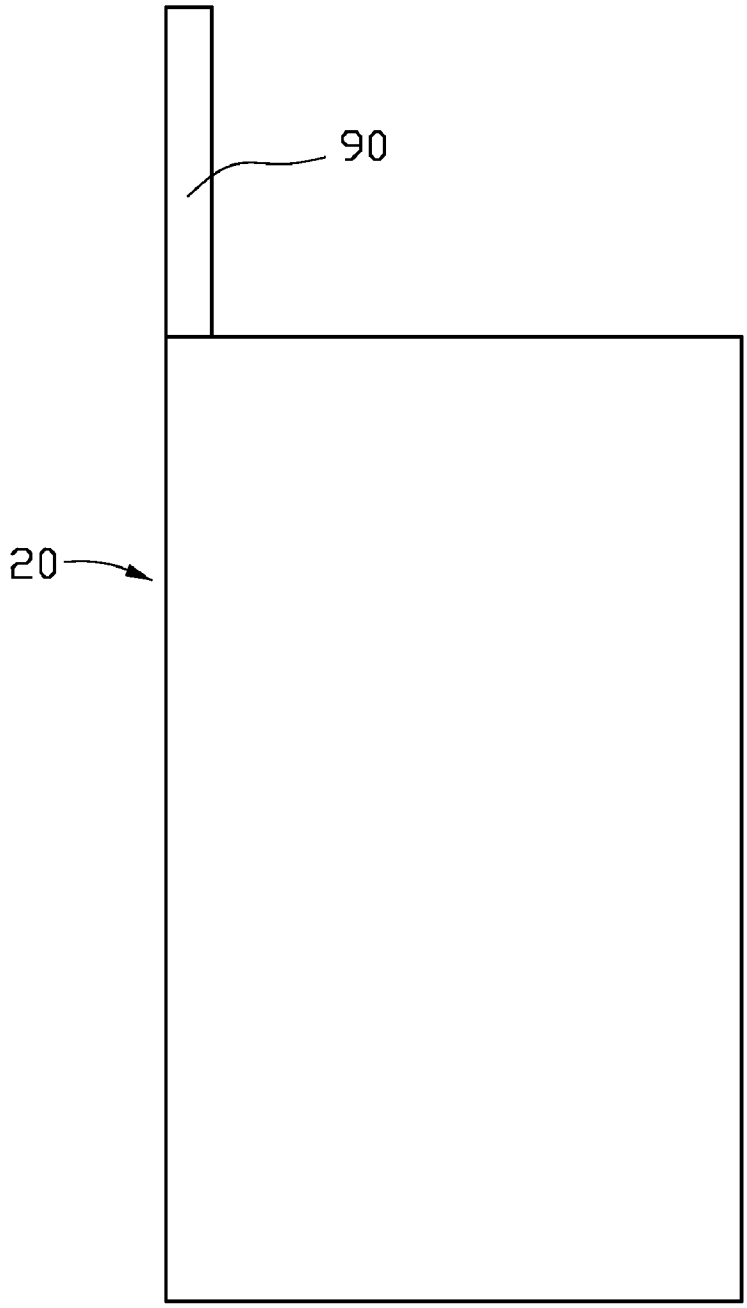
FIG. 1 (Related Art)
FIG. 1 is a schematic diagram of an conventional electronic device.
Figure 2:
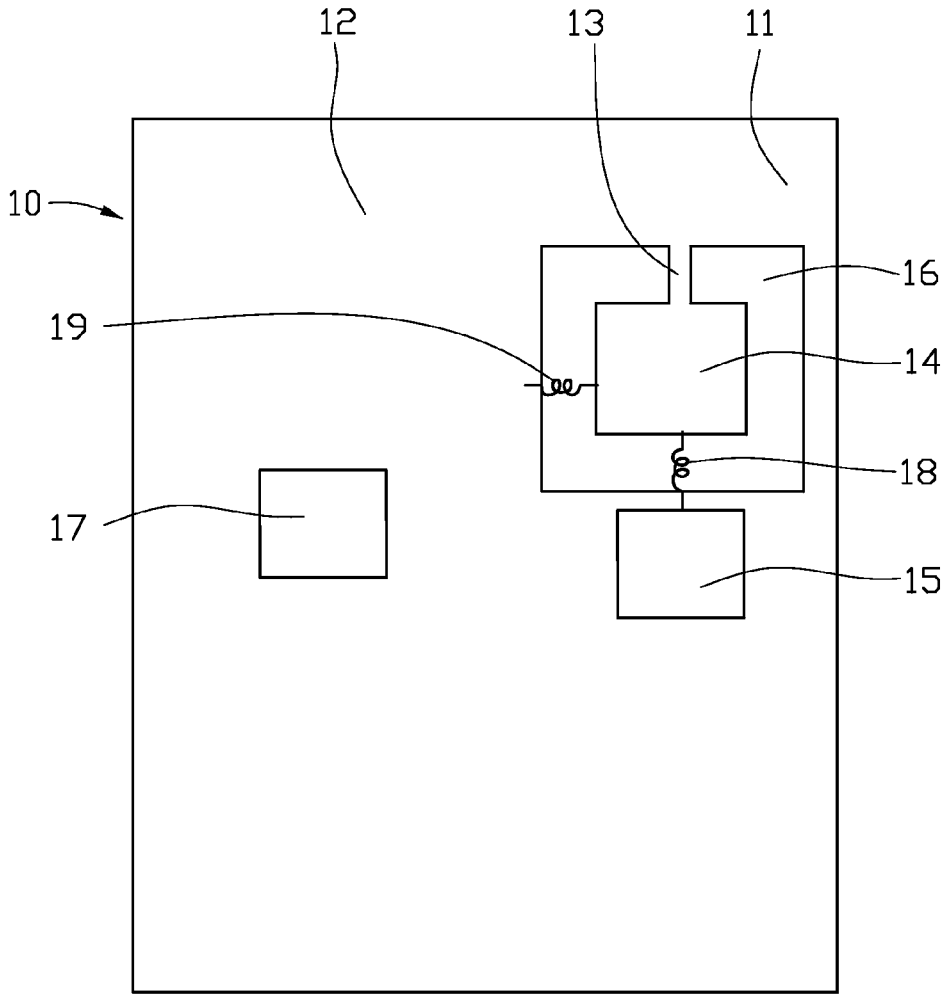
FIG. 2 is a schematic diagram of an electronic device in accordance with an embodiment of the invention.

FIG. 2 is a schematic diagram of an electronic device 10 in accordance with an embodiment of the invention. In this embodiment, the electronic device 10 is a mobile phone.

In this embodiment, the electronic device 10 includes a substrate 11, a metal film 12, a signal transmission portion 13, a radio frequency module 14, a first inductor 18, and a second inductor 19. The substrate 11 includes two opposite surfaces. The metal film 12, the signal transmission portion 13, the radio frequency module 14, the first inductor 18, and the second inductor 19 are disposed on one surface of the substrate 11.

The metal film 12 is used for radiating electromagnetic signals, and is used as ground usually. The signal transmission portion 13 is electronically connected to the radio frequency module 14 and the metal film 12 for transmitting electromagnetic signals between the radio frequency module 14 and the metal film 12. The signal transmission portion 13 can be a via if the radio frequency module 14 and the metal film 12 are formed on two opposite surfaces respectively. In this embodiment, the metal film 12 is cuprum film.

The radio frequency module 14 is used for generating electromagnetic signals. In this embodiment, the radio frequency module 14 may be a television (TV) module, a Bluetooth module, an application module of Digital Video Broadcasting-Handheld (DVB-H), etc. Advantageously, a clearance 16 is defined between the radio frequency module 14 and the metal film 12. The clearance 16 is an insulative area. In this embodiment, the clearance 16 is C-shaped. In other embodiments, the clearance 16 may be U-shaped, and so on.

The first inductor 18 and the second inductor 19 keep a distance from the signal transmission portion 13. One end of the first inductor 18 is electronically connected to the radio frequency module 14, and the other end thereof is connected to a first circuit 15 that supplies power or processes electromagnetic signals. One end of the second inductor 19 is electronically connected to the radio frequency module 14, and the other end thereof is connected to the metal film 12 for grounding. In other embodiments, the other end of the second inductor 19 may be connected to another grounded metal film. The number of the first inductor 18 and the second inductor 19 may be more than one. The first inductor 18 and the second inductor 19 may be a resistor, a capacitor, or a microstrip distributed component.

In this embodiment, the substrate may be a printed circuit board, the metal film 12 is a thin metal film on the printed circuit board. In other embodiments, one or more function circuits 17 may be disposed on the metal film 12.

In this embodiment, a length of the metal film 12 is about 100 mm, a width of the metal film 12 is about 40 mm. A length of the outer side of the clearance 16 is about 12 mm, and a length of the inner side of the clearance 16 is about 10 mm. The distance between the inner side and the outer side is about 1 mm. In other embodiments, the length of the inner side of the clearance 16 is determined according to an area of the radio frequency module 14. The distance between the inner side and the outer side is adjusted according to sizes of elements laid on the electronic device 10.

Figure 3:
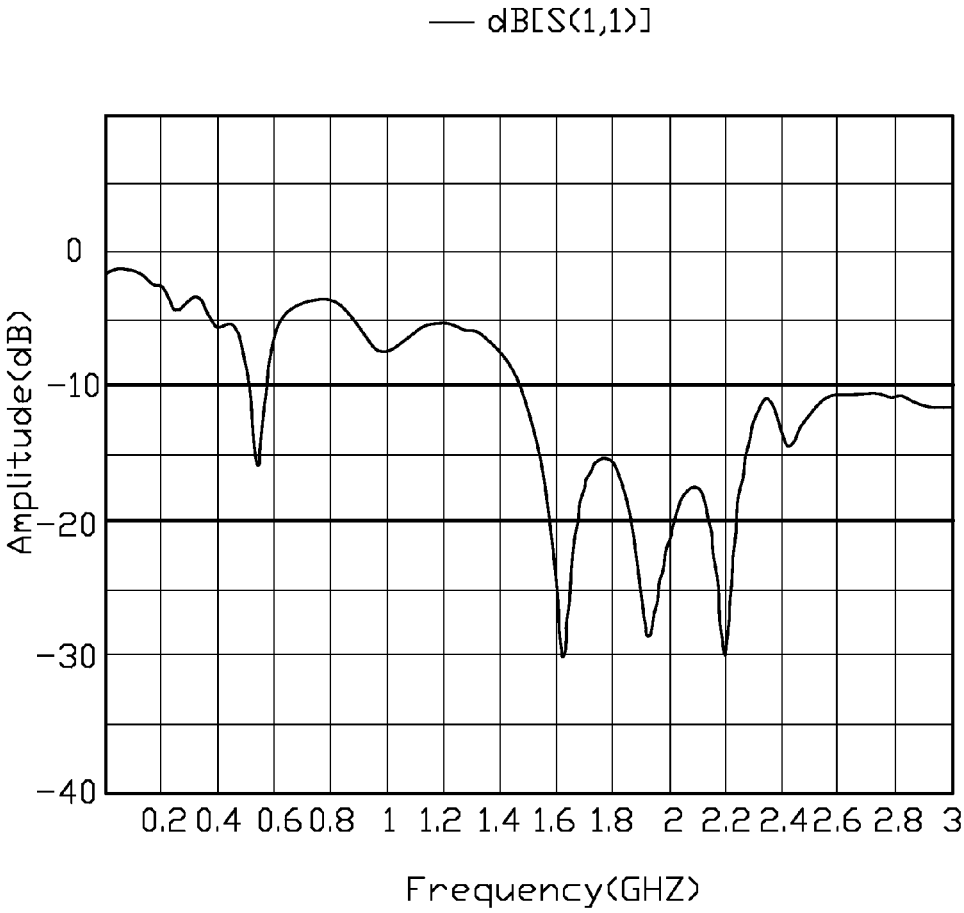
FIG. 3 is a graph of test results showing a return loss of a metal film of the electronic device of FIG. 2.

FIG. 3 is a graph of test results showing a return loss of the metal film 12 of the electronic device 10 of FIG. 2.

As shown in FIG. 3, when the metal film 12 operates at frequencies of 300 MHz-3 GHz, the amplitude values of the return loss in the band pass frequency range are smaller than −4 dB, which indicates that the electronic device 10 can be applied in the band pass frequencies of 300 MHz-3 GHz.

Figure 4:
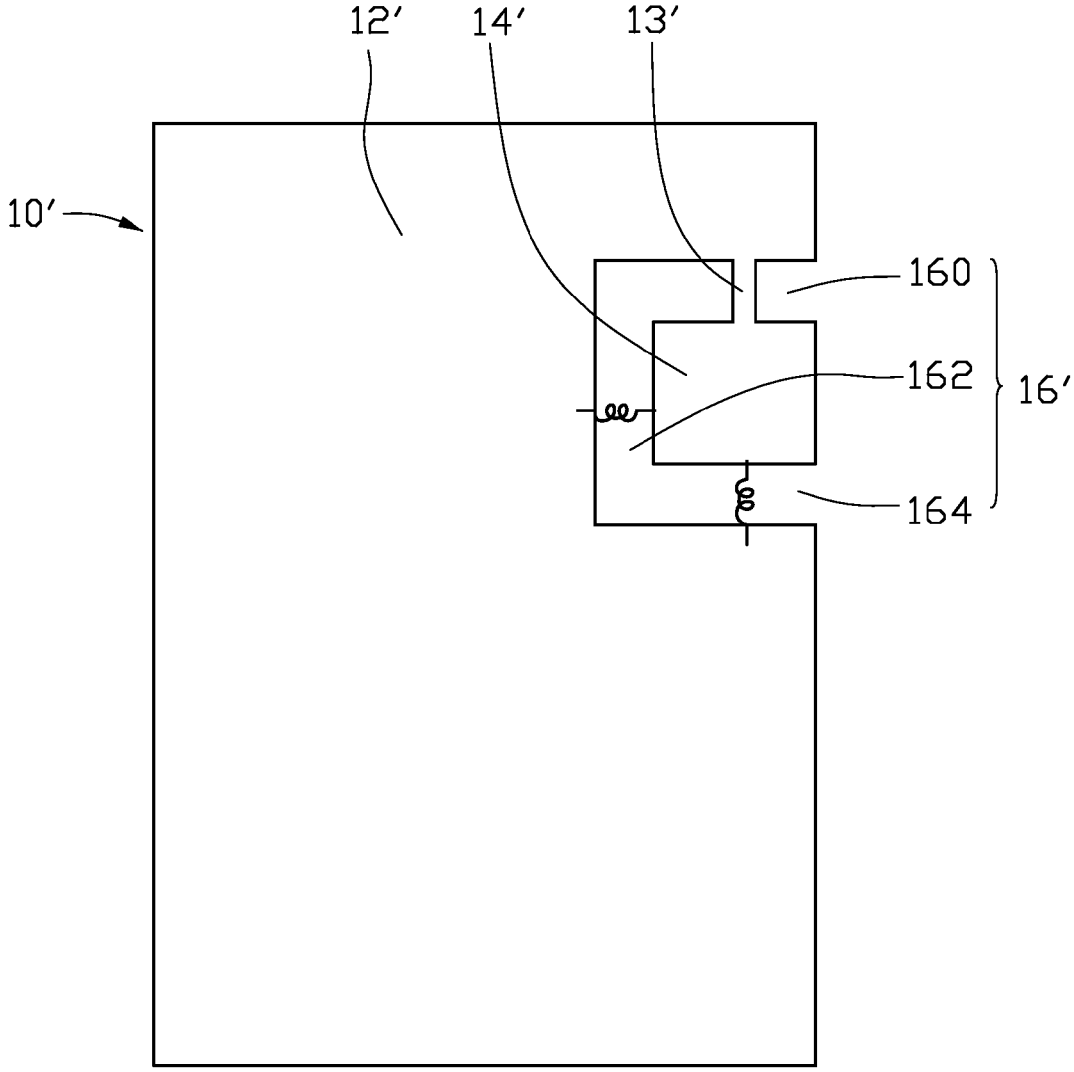
FIG. 4 is a schematic diagram of an electronic device in accordance with another embodiment of the invention.

FIG. 4 is a schematic diagram of an electronic device 10' in accordance with another embodiment of the invention. The difference between the electronic device 10' and the electronic device 10 in FIG. 2 is that a clearance 16' in FIG. 4 is on one edge of a metal film 12'. The clearance 16' is formed by a first groove 160, a second groove 162, and a third groove 164. The first groove 160, the second groove 162, and the third groove 164 surround a radio frequency module 14'.

In this embodiment, lengths of the outer sides of the first groove 160 and the third groove 164 are about 11 mm, and lengths of the inner sides are about 10 mm. The length of the outer side of the second groove 162 is about 10 mm, and the length of the inner side is about 10 mm. The distance between the inner side and the outer side of the first groove 160, the second groove 162, and the third groove 164 is about 1 mm. In other embodiments, the lengths of the inner sides of the first groove 160, the second groove 162, and the third groove 164 may be determined according to the sizes of the radio frequency module 14'. The distances between the inner and the outer sides of the first groove 160, the second groove 162, and the third groove 164 may be adjusted according to sizes of elements in the electronic device 10'.

Figure 5:
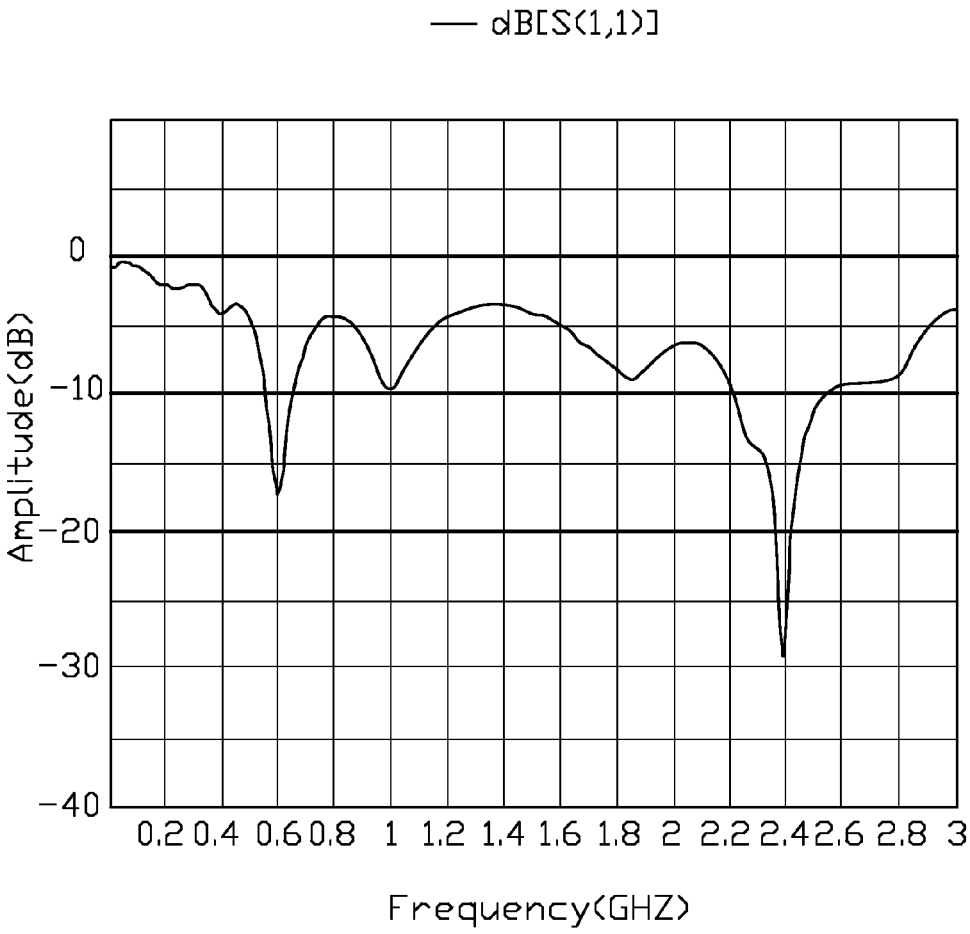
FIG. 5 is a graph of test results showing a return loss of a metal film of the electronic device of FIG. 4.

FIG. 5 is a graph of test results showing a return loss of the metal film 12' in the electronic device 10' of FIG. 4.

As shown in FIG. 5, when the metal film 12' operates at frequencies of 300 MHz-3 GHz, the amplitude values of the return loss in the band pass frequency range are smaller than −4 dB, which indicates that the electronic device 10' can be applied in the band pass frequencies of 300 MHz-3 GHz.

In other embodiments, the metal film 12 (12') used as a first metal film can be used for laying of circuits thereon or grounding. The radio frequency module 14 (14'), the clearance 16 (16'), the first inductor 18, and the second inductor 19 can be laid on the first metal film. Another metal film (not shown) disposed on the substrate 11 (11') used as a second metal film can be used for radiating electromagnetic signals or grounding. A connecting portion is electronically connected to the radio frequency module 14 (14') and the second metal film. The connecting portion passes through the first metal film.

In this embodiment, the radio frequency module 14 (14') is isolated from the metal film 12 (12') by the clearance 16 (16'), the metal film 12 (12') or other metal films disposed on the substrate 11 (11') can be used as antenna for transceiving electromagnetic signals, and be used as ground usually. Therefore, the area and the cost of the electronic device 10 (10') are reduced, and the electronic device 10 (10') implements ultra broadband. In other embodiments, the substrate 11 (11'), the metal film 12 (12'), and the signal transmission portion 13 (13') can cooperate as an antenna.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. An electronic device having antenna function, comprising:

a substrate comprising two opposite surfaces;

a metal film disposed on one surface of the substrate for radiating electromagnetic signals, and defining a clearance therein;

a radio frequency module disposed on the clearance, for generating electromagnetic signals; and a signal transmission portion, electronically connected to the radio frequency module and the metal film, for transmitting the electromagnetic signals between the radio frequency module and the metal film.

2. The electronic device as recited in claim 1, wherein the clearance is an insulative area on the metal film.

3. The electronic device as recited in claim 1, further comprising a first inductor electronically connecting the radio frequency module to a first circuit.

4. The electronic device as recited in claim 3, wherein the first circuit is used for supplying power or processing electromagnetic signals.

5. The electronic device as recited in claim 1, further comprising a second inductor electronically connecting the radio frequency module to the metal film.

6. The electronic device as recited in claim 1, further comprising one or more second function circuits disposed on the metal film.

7. A device having antenna function, comprising:

a substrate;

a metal film disposed on a surface of said substrate and occupying a major area of said surface, said metal film being grounded and being used for radiating electromagnetic signals; and a radio frequency module electrically connectable with said metal film for generating electromagnetic signals.

8. The device as recited in claim 7, wherein said radio frequency module is resided inside said major area for said metal film and separated from said metal film by a clearance.

9. The device as recited in claim 7, wherein said radio frequency module is electrically connectable with said metal film through a signal transmission portion.

* * * * *